US008231342B2

(12) United States Patent
Lacey et al.

(10) Patent No.: US 8,231,342 B2
(45) Date of Patent: Jul. 31, 2012

(54) IMPELLER ARRANGEMENT AND PUMP

(75) Inventors: Christopher George Lacey, Upway (AU); Mark Andrew Lance, Williamstown (AU)

(73) Assignee: Davey Products Pty Ltd., Victoria (AU)

( * ) Notice: Subject to any disclaimer, the term of this patent is extended or adjusted under 35 U.S.C. 154(b) by 827 days.

(21) Appl. No.: 11/989,016

(22) PCT Filed: Jul. 6, 2006

(86) PCT No.: PCT/AU2006/000959
§ 371 (c)(1),
(2), (4) Date: Feb. 26, 2009

(87) PCT Pub. No.: WO2007/009156
PCT Pub. Date: Jan. 25, 2007

(65) Prior Publication Data

US 2009/0191061 A1 Jul. 30, 2009

(30) Foreign Application Priority Data

Jul. 19, 2005 (AU) ..... 2005903829

(51) Int. Cl.
*F01D 1/02* (2006.01)

(52) U.S. Cl. ..... 415/198.1; 415/199.1; 415/203; 415/204; 415/100; 416/182

(58) Field of Classification Search ..... 415/198.1, 415/199.1, 199.2, 140; 416/214
See application file for complete search history.

(56) References Cited

U.S. PATENT DOCUMENTS

| | | | | |
|---|---|---|---|---|
| 3,612,716 | A * | 10/1971 | Deters | 415/140 |
| 3,764,236 | A * | 10/1973 | Carter | 417/372 |
| 4,428,717 | A * | 1/1984 | Catterfeld | 416/186 R |
| 4,887,940 | A | 12/1989 | Todoroki et al. | |
| 5,340,273 | A | 8/1994 | Rockwood | |
| 6,296,459 | B1 * | 10/2001 | Saputo et al. | 417/423.14 |
| 6,884,037 | B2 * | 4/2005 | Lacey et al. | 416/214 R |
| 7,290,984 | B2 * | 11/2007 | Volk | 415/199.2 |
| 2003/0138323 | A1 * | 7/2003 | Lacey et al. | 416/182 |
| 2006/0269404 | A1 * | 11/2006 | Volk | 415/198.1 |
| 2010/0221105 | A1 * | 9/2010 | Markovitch | 415/199.1 |

FOREIGN PATENT DOCUMENTS

SU 1652666 5/1991

OTHER PUBLICATIONS

International Search Report dated Aug. 31, 2006.

* cited by examiner

*Primary Examiner* — Steven Loke
*Assistant Examiner* — David Goodwin
(74) *Attorney, Agent, or Firm* — Jacobson Holman PLLC

(57) ABSTRACT

A multi-impeller arrangement and to a pump having the impeller arrangement. The impeller arrangement or impeller cluster includes at least two impellers, each impeller having an annular back plate and an annular front plate. The impellers are releasably secured together in an axially in-line series having the front plate of a first impeller at one end and the back plate of a second impeller at the other end. The second impeller includes an axial projection which extends from its back plate, through and beyond its front plate to the first impeller. The first impeller is engaged with the projection of the second impeller such that all impellers are rotatable as an assembly.

22 Claims, 4 Drawing Sheets

IMPELLER ARRANGEMENT AND PUMP

This is a national stage of PCT/AU06/000959 filed Jul. 6, 2006 and published in English.

FIELD OF THE INVENTION

The present invention relates to an improved multi-impeller arrangement and to a pump having the impeller arrangement.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Current multi-impeller pumps have two or more identical impellers. Each of these impellers fits onto a respective separable keyed extension of the drive motor stub shaft. That is, each impeller after the first necessitates its own, further extension. Also, the current multi-impeller pumps have the halves of each impeller riveted or welded to each other, while a secondary fastener locates the impellers on or in relation to the extension shaft.

The present invention is directed to providing an alternative multi-impeller arrangement having at least two impellers.

While the arrangement of the present invention is very well suited to a multi-impeller arrangement having two impellers, it can be adapted for three or even more impellers. For ease of description, the invention largely is described with reference to an arrangement having two impellers.

SUMMARY OF THE INVENTION

The impeller arrangement of the present invention has at least two impellers which are able to be assembled together to form a unit, herein referred to as an impeller cluster. According to one broad aspect of the present invention, there is provided an impeller cluster for a pump including at least two impellers, each impeller having an annular back plate and an annular front plate, the impellers being releasably secured together in an axially in-line series having the front plate of a first impeller at one end and the back plate of a second impeller at the other end, wherein the second impeller includes an axial projection which extends from its back plate, through and beyond its front plate to the first impeller, the first impeller being engaged with the projection of the second impeller such that all impellers are rotatable as an assembly.

In some embodiments, the impeller cluster can include three or more impellers. In these embodiments, the impeller cluster includes at least one intermediate impeller between the first and second impellers, the axial projection extending through each intermediate impeller, each intermediate impeller being engaged with the projection of the second impeller such that all impellers are rotatable as an assembly. Each of the first, second and intermediate impeller(s) may be engaged to the projection of the second impeller in an arrangement which provides a fixed axial spacing between the impellers.

The back plate of each impeller may have an axial extension projecting from its inner periphery. Such an extension preferably defines an annular abutment against which the respective front plate locates. The front plate of each impeller may have an annular opening at its inner periphery in which a plurality of angularly spaced radial vanes join a hub and the front plate. Starting from the second impeller, the hub of the front plate preferably defines an annular abutment against which the next impeller locates.

The axial projection of the second impeller can include means for providing a coupling between the cluster and a drive motor for rotating the cluster. In a preferred arrangement of the invention, the axial projection of the back plate of the second impeller defines a bore in which the stub axle of a drive motor is releasably engageable for rotating the cluster. Also, the projection of that back-plate extends through and beyond the hub of the front plate of the second impeller, through the extension of the back plate of the first impeller, and through and beyond the extension and hub of the back and front plate, respectively, of any intermediate impeller.

One or both of the extension of the back plate and the hub of the first impeller releasably engage an adjacent end of the projection of the back plate of second impeller to secure the cluster of impellers in assembly. In one arrangement, a fastener received through the hub of the first impeller and an adjacent end of the projection of the second impeller secures the cluster of impellers in assembly. The fastener releasably engages the adjacent end of that projection to one or both of the hub and the extension of the back plate of the first impeller. In another arrangement, the hub of the front plate of the first impeller may be threaded on that adjacent end of the extension to secure the cluster of impellers in assembly. In yet another arrangement, the adjacent end of the projection of the back plate is releasably engaged to one or both of the hub and the extension of the back plate of the first impeller using a bayonet type fitting. In some embodiments, the front plate of the first impeller includes an element which helps immobilise the front plate with respect to the projection of the back plate in order to assist assembly of the cluster. Preferably, the element is a flange, more preferably a hexagonal flange around which a tool such as a spanner can be received.

Additional securement of the projection of the back plate of second impeller to the first impeller can be provided through an interference fit between engaging parts of the projection of the back plate of the second impeller and components of the first impeller. In one arrangement, the adjacent end of the projection of the back plate of second impeller and the extension of the back plate of the first impeller have complementary axial cross-sections which provide an interference fit that precludes axial rotation of the projection of the back plate of second impeller relative to the first impeller. In one arrangement, the complementary axial cross-sections are non-circular. Preferably, the complementary axial cross-sections are hexagonal. In other arrangements, the complementary axial cross-sections could include a rib and groove or keyed arrangement which prevents axial rotation of the projection of the back plate of second impeller relative to the first impeller.

Each impeller defines an inlet or eye through which low pressure liquid can be drawn through under the action of the impeller. The liquid is caused to flow into a space between the front and back plates of the impeller, from which it is directed by vanes to a high pressure region around the periphery of the impeller. The vanes may be formed on one or each of the front and back plates. In a pump having the impeller cluster, liquid at the eye of the first impeller is caused to flow from the outer periphery of the first impeller, through the eye and to the outer periphery of the second impeller, and then to at least one outlet of the pump. In flowing from the first to the second impeller, the liquid flows similar in turn through any intermediate impeller in advance of reaching the second impeller. The impellers of the cluster are able to co-operate with seals for enhancing the efficiency of operation of the pump.

The front plate of each impeller preferably has an annular skirt which projects forwardly from the inner periphery of the front plate, around the hub. The outer surface of the skirt may have a cylindrical outer surface on which a first floating annular seal is able to be provided. The first seal is intended to prevent liquid from flowing from the outer periphery of the impeller, across the front surface of the front plate to the inlet or eye. Each impeller preferably has spacer means which space the seal from the front surface of the front plate, to facilitate liquid pressure which moves the seal away from the front surface for sealing against an annular rim defined in a pump housing in which the cluster is provided. Thus, the seal floats under the pressure of liquid seeking to return to the pump inlet, to prevent that return.

The inlet or eye of each impeller is subjected to low pressure relative to the rest of the impeller. Due to this, the impeller cluster tends to move forward in the pump, away from the drive motor. Thus, there is an axial load passed to the drive shaft of the motor and its support bearings. When the pump operates at high pressure, the imbalance (and the load it generates) is greatest. Extended running at high pressure causes the motor bearings to fail prematurely. Each impeller of the cluster therefore preferably has means, including a second floating seal, which offsets these loads, at least to a significant extent.

To offset such loads, each impeller has an annular collar which projects rearwardly from its back plate towards an annular rim defined in the pump housing. The collar has a diameter larger than the inner periphery of the back plate and is adapted to co-operate with a second annular floating seal. The second seal is intended to reduce the area at the back surface of the back plate over which high pressure liquid is able to act, by that pressure moving the second seal towards or away from that back surface for providing a seal between the annular collar and the annular rim defined in the pump housing. The action of the second seal preferably is assisted by at least one passage which opens through the back plate, between the collar and the inner periphery of that plate, by which a low pressure comparable to that at the inlet or eye is able to prevail over an area of the back surface of the back plate. The respective areas of low and high pressure at each axial side of the impeller are preferably substantially balanced so as to balance pressure vectors on the drive shaft.

DESCRIPTION OF THE DRAWINGS

In order that the invention may more readily be understood, description now is directed to the accompanying drawings which illustrated preferred embodiments of the impeller pump incorporating an impeller cluster according to the present invention. It is to be understood that the impeller cluster and pump are not limited to the preferred embodiment as hereinafter described and as illustrated in the drawings. In the drawings.

DETAILED DESCRIPTION OF A PREFERRED EMBODIMENT OF THE INVENTION

Figure 3:
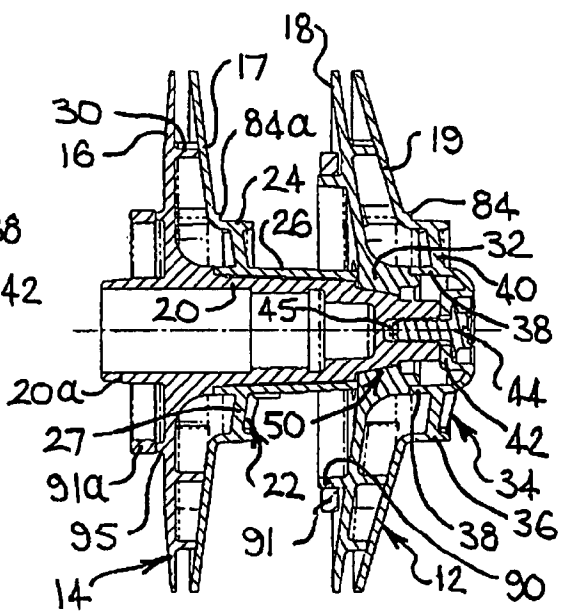
FIG. 3 is a sectional view of the impeller cluster, taken on line A-A of FIG. 1.

With reference to FIGS. 1 to 4, there is shown an impeller cluster 10 having two axially spaced impellers 12, 14. Following the preceding designations, the cluster 10 has a first impeller 12 and a second impeller 14. The second impeller 14 has an annular back plate 16 and an annular front plate 17. The first impeller 12 similarly has back and front annular plates 18 and 19, respectively. However, whereas plate 16 is substantially flat, plate 18 (like plates 17 and 19) is frusto-conical so as to flare outwardly and rearwardly.

Plate 16 of second impeller 14 has a hub 20 extending axially from its inner periphery. The hub 20 has a short portion 20*a* extending rearwardly from plate 16, while its main extent passes through plate 17 and has impeller 12 mounted on its forward end. Plate 17 defines an annular inlet or eye 22 for impeller 14. The eye 22 is defined between a short skirt 24 at the inner periphery of plate 17, and an elongate tubular hub 26 disposed concentrically within skirt 24. Hub 26 secured in relation to plate 17 by angularly spaced radial vanes 27 extending between skirt 24 and hub 26.

As best illustrated in FIG. 3, plates 16 and 17 of impeller 14 are secured in relation to each other by hub 26 being neatly received on hub 20 of plate 16, to locate the rearward end of hub 26 against a shoulder 28 defined by a circumferential step in hub 20. This positioning locates the rear face of front plate 17 against vanes 30 formed integrally with the front face of rear plate 16. As will be appreciated, the vanes 30 could be on the rear face of plate 17 as illustrated, or alternately the vanes 30 could be provided on each of plates 16 and 17.

Plate 18 of first impeller 12 has a short hub 32 extending forwardly from its inner periphery. Also, plate 19 defines an annular inlet or eye 34 for impeller 12. The eye 34 is defined between short concentric skirts 36 and 38, of which the radially outer skirt 36 extends from the inner periphery of plate 19. The skirt 38 is joined to plate 19 by angularly spaced radial vanes 40 extending between skirts 36 and 38, while the forward end of skirt 38 is covered by a dished end wall 42.

Figure 4:
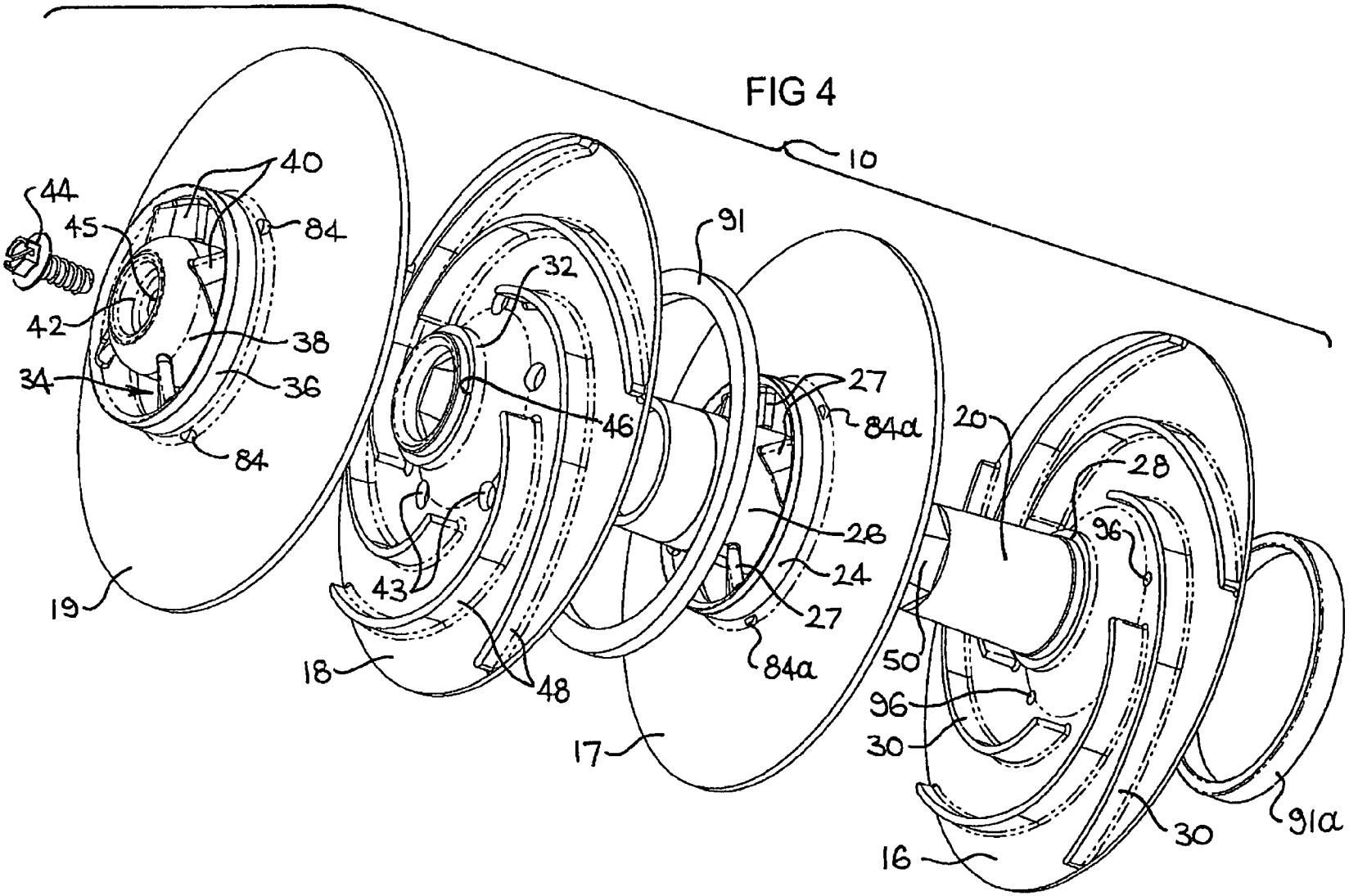
FIG. 4 is an exploded perspective view of the impeller cluster of FIG. 1.

As can be most clearly seen in FIGS. 3 and 4, hub 20 of plate 16 of second impeller 14 extends beyond the forward end of hub 26 of plate 17, and has first impeller 12 mounted on its forward end. For this, the end portion of hub 20 extending beyond hub 26 passes through hub 32 and within skirt 38 of respective plates 18 and 19 of the first impeller 12. This arrangement is maintained by a fastener 44 which extends through end wall 42 of skirt 38 and is in threaded engagement in a threaded axial bore 45 in the forward end of hub 20. As fastener 44 is tightened to locate end wall 42 firmly against the end of hub 20, the rear end of hub 32 of rear plate 18 is located firmly against the forward end of elongate tubular hub 26 of plate 17 of impeller 14. Also, tightening of fastener 44 locates the rear end of skirt 38 against an annular shoulder 46 defined at the forward end of hub 32 and the rear face of plate 19 against vanes 48 on the front face of plate 18 (although as can be appreciated vanes 48 can be in other embodiments on plate 19 or on each of plates 18 and 19). Additionally, tightening of fastener 44 secures plates 16 and 17 of impeller 12 in relation to each other. Thus the two impellers 12 and 14 then comprise a unit or cluster.

As seen in FIGS. 3 and 4, the portion of hub 20 within hub 32 of plate 18 is tapered, shown as tapered portion 50, while the inner periphery of hub 32 has a complementary form. Also, tapered portion 50 and the inner periphery of hub 32 have non-circular axial cross-sections to preclude rotation of impeller 12 relative to impeller 14. In the arrangement shown, tapered portion 50 has a hexagonal cross-section, while the inner periphery of hub 32 has a complementary hexagonal cross-section.

Figure 4A:
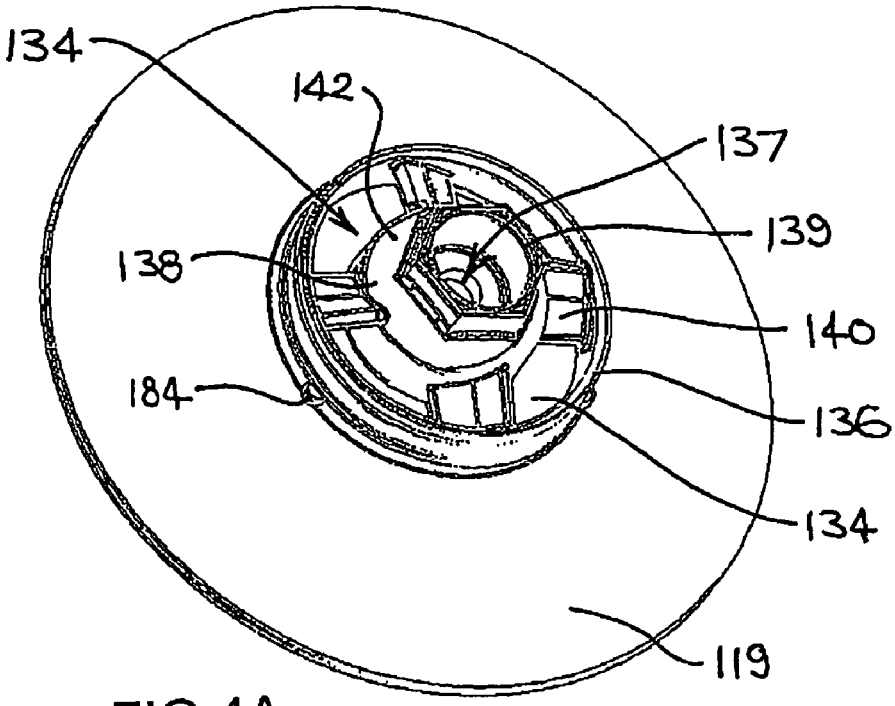
FIG. 4A is a front end elevation of a front plate for an impeller cluster according to another embodiment of the present invention.
Figure 4B:
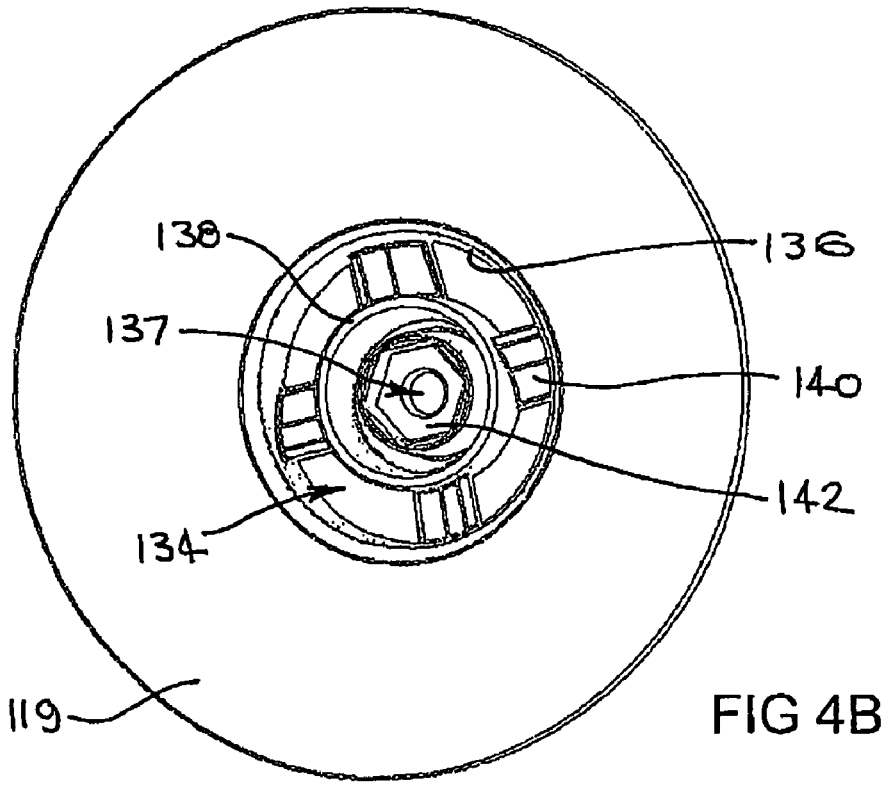
FIG. 4B is a rear end elevation of a front plate for an impeller cluster according to another embodiment of the present invention.

FIGS. 4A and 4B show another form of the front annular plate 119 of the first impeller 12 which can be fitted to the impeller cluster 10. The front plate 119 shown in FIGS. 4A and 4B has a similar configuration to the front plate 19 shown in FIGS. 1 to 4, and therefore like features have been labelled with the same reference numerals plus 100. The front plate 119 shown in FIGS. 4A and 4B differ to the front plate shown in FIG. 1 through the inclusion of an additional hexagonal flange 139 extending from the front face of the dished end wall 142 of the forward end of skirt 138. The hexagonal flange 139 is designed to be engaged by a spanner to allow the front plate to be immobilized using the spanner when the impeller cluster 10 is being assembled.

In a similar manner as described for plate 19, the front plate 119 is fastened to the forward end of hub 20 (FIG. 3) using a fastener 44 which extends through bore hole 137 in end wall 142 of skirt 138 and is fastened in threaded engagement in a threaded axial bore 45 in the forward end of hub 20 (FIG. 3). As best illustrated in FIG. 4B, this embodiment of the front plate 119 has a hexagonal shaped recess 141 formed in the end wall 142. The forward end of hub 20 has a complimentary hexagonal shape (not illustrated) which is fitted into recess 141 on assembly, thereby preventing plate 119 spinning independently of the impeller cluster 10.

Figure 2:
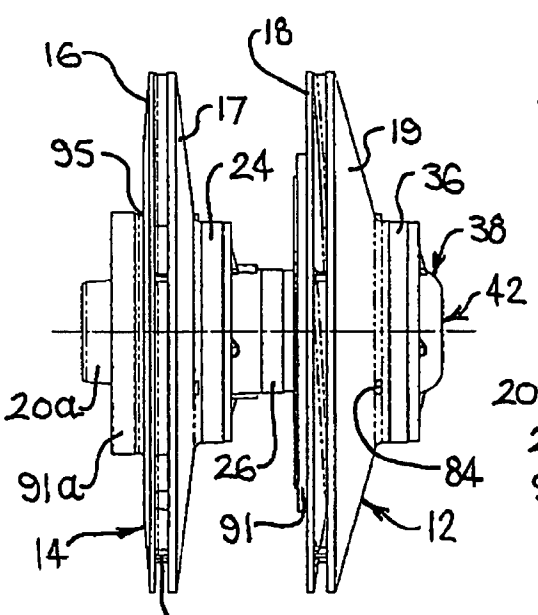
FIG. 2 is a side elevation of the impeller cluster of FIG. 1.
Figure 1:
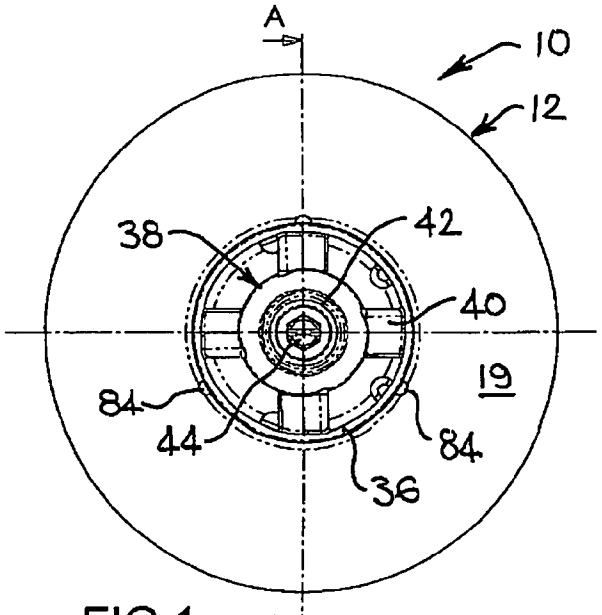
FIG. 1 is a front end elevation of an impeller cluster according to one embodiment of the present invention.
Figure 5:
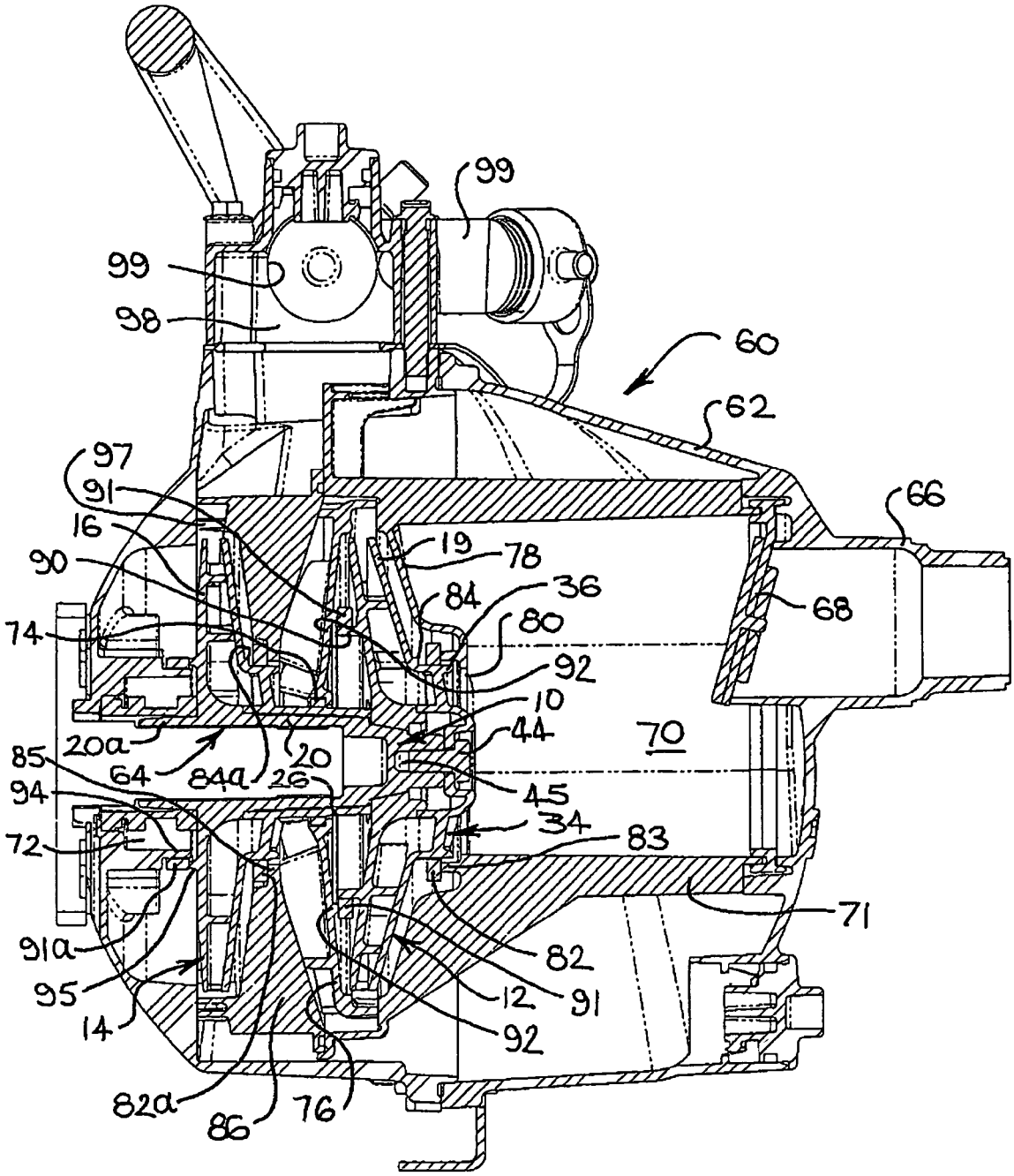
FIG. 5 is a sectional view of a two-stage pump incorporating an impeller cluster according to FIGS. 1 to 4.

Further details of impeller cluster 10 now are described with reference to FIG. 5, showing a pump 60 including cluster 10. In FIG. 5, various seals co-operable with cluster 10 are shown and, while not part of impellers 12 and 14 of cluster 10, some seals 91, 91*a* also are shown in FIGS. 2 to 4.

The pump 60 includes a fixed housing 62 in which impeller cluster 10 is rotatable. The stub axle (not shown) of a motor (also not shown) for driving pump 60 is able to be drivingly received in a bore 64 defined within hub 20 of plate 16 of impeller 14. Housing 62 has a connector 66 through which a liquid such as water is able to be drawn through pump 60 under the action of impeller cluster 10 when cluster 10 is rotated by the motor. At the inner end of connector 66, there is a one-way flap valve 68 which is able to be displaced inwardly to enable water to enter and fill chamber 70 within sub-housing 71 of pump 60. Impeller cluster 10 is rotatable with housing 62 by being retained in a rotating seal 72, for example, a rotating carbon-ceramic seal, between housing 62 and rearward portion 20*a* of hub 20 of impeller 14, and by a balance drum seal 74 between partition wall 76 of housing 62 and the outer periphery of elongate tubular hub 26 of impeller 14. The seal 74 prevents pressurized water passing to the eye 22 of impeller 14 from being diverted back along hub 26 to impeller 12.

Adjacent to the forward end of impeller cluster 10, sub-housing 71 has a transverse wall 78. An opening 80 in wall 78 provides communication between chamber 70 and the inlet or eye 34 of impeller 12. With rotation of cluster 10, water is able to be drawn through eye 34, to flow outwardly between plates 18 and 19 of impeller 12 and beyond the outer periphery of impeller 12. A higher pressure prevails at the periphery of impeller 12 than the pressure at eye 34, tending to cause water to flow back to eye 34 across the front of plate 19. To offset this tendency, an annular floating seal 82 is provided around skirt 36 of plate 19. The seal 82 is a neat sliding fit on the cylindrical periphery of skirt 36 and the pressure of high pressure water at the front face of plate 19 acts on the rear face of seal 82 to force it forwardly on skirt 36. The seal thus is caused to bear against an annular fin 83 defined by wall 78, around opening 80, to prevent the return flow of water to eye 34. To facilitate access of water pressure to seal 82, circumferentially spaced lugs 84, best seen in FIG. 4, are provided around the inner periphery of plate 19 to limit the extent to which seal can move rearwardly.

For the same purpose, a seal 82*a* is provided on skirt 24 of plate 17 of impeller 14. Thus, water is prevented from flowing from the outer periphery of impeller 14, to eye 22. For this, seal 82*a* is caused to seal against annular abutment 85 defined around skirt 24 by end wall 86 of sub-housing 71. Lugs 84*a* spaced around the periphery of plate 17 limit the extent to which seal 82*a* is able to move towards plate 17, to ensure that higher pressure water at the front face of plate 17 is able to act against the rear face of seal 82*a*.

With pump 60 as described to this stage, high pressure prevailing at the rear face of respective plates 16 and 18 of impellers 14 and 12 would act to force impeller cluster 10 forwardly, i.e. to the right in FIG. 5. A resultant axial load would be transferred to the drive shaft of a motor coupled to cluster 10, and to the support bearings for the drive shaft, leading to premature failure of the bearings. Each of impellers 12 and 14 is provided with means for offsetting this axial load.

In the case of impeller 12, an annular fin 90 is provided on the rear face of plate 18, orientated radially outwardly with respect to skirt 36 of plate 19. An annular floating seal 91 has a neat sliding fit on the cylindrical outer periphery of fin 90. Water at a relatively high pressure tending to flow from the outer periphery of impeller 12, across the rear face of plate 18, acts on the front face of seal 91. The seal 91 therefore is moved rearwardly, to the left in FIG. 5, to seal against an annular fin 92 provided around the adjacent front face of partition wall 76 of housing 62. Thus, seal 91 reduces the area of the rear face of plate 18 against which water at a high pressure is able to act. Also, openings 93 are provided in plate 18, radially inwardly of fin 90, such that the pressure prevailing at the rear face of plate 18, inwardly of fin 90, is substantially the same as the low pressure at eye 34 of impeller 12.

Somewhat similarly, a floating seal 91*a* is provided at the rear face of plate 16 of impeller 14. However, in this instance, seal 91*a* is sealingly slidable on an annular skirt 94 defined by housing 62 and concentrically disposed around seal 72. Thus, the seal 91*a* is movable forwardly to seal against the rear face of a fin 95 on the rear face of plate 16 of impeller 14. Also, openings 96 are provided in plate 16 to balance substantially the water pressure at the rear face of plate 16, inwardly of fin 95, with the pressure at eye 22 of impeller 14.

As a consequence of the pressure reducing effect of the arrangement of seals 91 and 91*a*, and the pressure balancing effect of openings 93 and 96, the tendency for impeller cluster 10 to be moved forwardly, and thereby apply an axial load to the motor drive shaft, is able to be substantially reduced, thereby protecting the drive shaft bearings against undue loads.

In use of pump 60, higher pressure water issuing from the periphery of impeller 12 passes through vanes in the radially outer extent of partition 76. While not readily discernable in the Figures, the vanes are in the curved outer portion over which partition 76 curves around the periphery of impeller 12 to join sub-housing 71. From those vanes the water passes to the eye 22 of impeller 14. Water issuing from the outer periphery of impeller 14 passes through further vanes 97 defined in sub-housing 71, around impeller 14. From vanes 97, the high pressure water passes to chamber 98, from which it is able to be discharged through at least one of outlet connections 99.

Finally, it is to be understood that various other modifications and/or alterations may be made without departing from the spirit of the present invention as outlined herein.

The invention claimed is:

1. An impeller cluster for a pump, said impeller cluster comprising at least three impellers, each impeller having an annular back plate and an annular front plate, the impellers being releasably secured together in an axially in-line series having the front plate of a first impeller at one end and the back plate of a second impeller at the other end, the second impeller including an axial projection which extends from its back plate, through and beyond its front plate to the first impeller, the first impeller being engaged with the projection of the second impeller, at least one intermediate impeller between the first and second impellers, the axial projection extending through each intermediate impeller, each intermediate impeller being engaged with the projection of the second impeller such that all impellers are rotatable as an assembly.

2. The impeller cluster according to claim 1, wherein each of the first, second and intermediate impeller(s) are engaged to the projection of the second impeller in an arrangement which provides a fixed axial spacing between the impellers.

3. The impeller cluster according to claim 1, wherein the axial projection of the second impeller includes means for providing a coupling between the cluster and a drive motor for rotating the cluster.

4. The impeller cluster according to claim 3, wherein the axial projection of the back plate of the second impeller defines a bore in which the stub axle of a drive motor is releasably engageable for rotating the cluster.

5. The impeller cluster according to claim 1, wherein the back plate of each impeller includes an axial extension projecting from its inner periphery providing an annular abutment against which the respective front plate of the impeller is located.

6. The impeller cluster according to claim 5, wherein the front plate of each impeller includes a hub which provides an annular abutment against which the next impeller is located.

7. The impeller cluster according to claim 6, wherein the front plate of each impeller includes an annular opening at its inner periphery in which a plurality of angularly spaced radial vanes join the hub and the front plate.

8. The impeller cluster according to claim 1, wherein each impeller defines an inlet or eye at which low pressure liquid is able to be drawn in under the action of the impeller.

9. The impeller cluster according to claim 8, wherein each impeller includes a plurality of vanes formed on one or each of the front and back plates which direct liquid to flow from the eye, through a space between the front and back plates of the impeller to a high pressure region around the periphery of the impeller.

10. The impeller cluster according to claim 5, wherein the front plate of each impeller has an annular skirt which projects forwardly from the inner periphery of the front plate, around the hub, the outer surface of the skirt having a cylindrical outer surface on which a first floating annular seal is provided.

11. The impeller cluster according to claim 10, wherein each impeller has spacer means which space the first floating annular seal from a front surface of the front plate to facilitate liquid pressure which moves the first floating annular seal away from the front surface of the front plate for sealing against an annular rim defined in a pump housing in which the cluster is provided.

12. The pump including an impeller cluster according to claim 1.

13. An impeller cluster for a pump, said impeller cluster comprising at least two impellers, each impeller having an annular back plate and an annular front plate, the impellers being releasably secured together in an axially in-line series having the front plate of a first impeller at one end and the back plate of a second impeller at the other end, the second impeller including an axial projection which extends from its back plate, through and beyond its front plate to the first impeller, the first impeller being engaged with the projection of the second impeller such that all impellers are rotatable as an assembly, the back plate of each impeller including an axial extension projecting from its inner periphery providing an annular abutment against which the front plate of the impeller is located, the front plate of each impeller including a hub which provides an annular abutment against which the next impeller is located, and the projection of the back-plate of the second impeller extending through and beyond the hub of the front plate of the second impeller, through the extension of the back plate of the first impeller, and through and beyond the extension and hub of the back and front plate, respectively, of any intermediate impeller.

14. The impeller cluster according to claim 13, wherein one or both of the extension of the back plate and the hub of the first impeller releasably engage an adjacent end of the projection of the back plate of second impeller to secure the cluster of impellers in assembly.

15. The impeller cluster according to claim 13, wherein a fastener received through the hub of the first impeller and an adjacent end of the projection of the second impeller secures the cluster of impellers in assembly.

16. The impeller cluster according to claim 13, wherein the hub of the front plate of the first impeller is threaded onto the adjacent end of the extension to secure the cluster of impellers in assembly.

17. The impeller cluster according to claim 5, wherein the adjacent end of the projection of the back plate of second impeller and the extension of the back plate of the first impeller have complementary axial cross-sections which provide an interference fit that precludes axial rotation of the projection of the back plate of the second impeller relative to the first impeller.

18. The impeller cluster according to claim 17, wherein the complementary axial cross-sections are non-circular.

19. An impeller cluster, for a pump, said impeller cluster comprising at least two impellers, each impeller having an annular back plate and an annular front plate, the impellers being releasably secured together in an axially in-line series having the front plate of a first impeller at one end and the back plate of a second impeller at the other end, the second impeller including an axial projection which extends from its back plate, through and beyond its front plate to the first impeller, the first impeller being engaged with the projection of the second impeller such that all impellers are rotatable as an assembly, and each impeller of the cluster including means which cooperates with a floating seal to substantially offset axial loads passed to a drive shaft of a motor and its support bearings loads.

20. The impeller cluster according to claim 19, wherein each impeller has an annular collar which projects rearwardly from its back plate towards an annular rim defined in a pump housing in which the cluster is provided, the collar having a diameter larger than an inner periphery of the back plate and being adapted to co-operate with the floating seal.

21. The impeller cluster according to claim 20, wherein the back plate of each impeller includes at least one passage between the collar and the inner periphery of that plate which cooperates with the floating seal to provide a pressure comparable to a pressure at an inlet or eye of the impeller over an area of the back surface of the back plate.

22. The impeller cluster according to claim 21, wherein the floating seal and at least one passage substantially balance respective areas of low and high pressure at each axial side of the impeller so as to balance pressure vectors on the drive shaft.

* * * * *